US009157404B2

(12) United States Patent
Magel

(10) Patent No.: US 9,157,404 B2
(45) Date of Patent: Oct. 13, 2015

(54) FUEL INJECTOR HAVING PRESSURE SENSOR

(75) Inventor: Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 957 days.

(21) Appl. No.: 13/263,957

(22) PCT Filed: Mar. 11, 2010

(86) PCT No.: PCT/EP2010/053081

§ 371 (c)(1),
(2), (4) Date: Oct. 11, 2011

(87) PCT Pub. No.: WO2010/127889

PCT Pub. Date: Nov. 11, 2010

(65) Prior Publication Data

US 2012/0031376 A1 Feb. 9, 2012

(30) Foreign Application Priority Data

May 7, 2009 (DE) ..... 10 2009 002 895

(51) Int. Cl.

| | |
|---|---|
| ***F02M 51/00*** | (2006.01) |
| ***F02M 63/00*** | (2006.01) |
| ***F02M 57/00*** | (2006.01) |
| *F02M 47/02* | (2006.01) |

(52) U.S. Cl.

CPC ..... *F02M 63/0026* (2013.01); *F02M 57/005* (2013.01); *F02M 63/008* (2013.01); *F02M 47/027* (2013.01); *F02M 2200/24* (2013.01)

(58) Field of Classification Search

CPC .... F02M 69/04; Y02T 10/32; F02D 41/0027; F02D 19/0694; F02D 2200/0602

USPC ..... 123/445, 446, 447, 457, 494, 458, 514; 73/114.45, 114.46, 114.47, 114.48, 73/114.49, 114.51

See application file for complete search history.

(56) References Cited

U.S. PATENT DOCUMENTS 5,979,803 A * 11/1999 Peters et al. ..... 239/533.4
6,598,591 B2 7/2003 Lewis (Continued)

FOREIGN PATENT DOCUMENTS

DE 102005054927 5/2007
DE 102006055486 5/2008

(Continued)

OTHER PUBLICATIONS

PCT/EP2010/053081 International Search Report.

(Continued)

*Primary Examiner* — Hai Huynh
*Assistant Examiner* — Raza Najmuddin
(74) *Attorney, Agent, or Firm* — Michael Best & Friedrich LLP

(57) ABSTRACT

The invention relates to a fuel injector (1) having a high pressure region (32) which contains fuel that is under high pressure during operation, and a low pressure region (38) in which a lower pressure is present during operation than in the high pressure region (32). A sensor (12) is located in the low pressure region (38) and a transmission means (9) is arranged such that a force which is equal to the pressure of the fuel in the high pressure region (32) is exerted on the sensor (12) at least some of the time.

15 Claims, 2 Drawing Sheets

(56) References Cited

U.S. PATENT DOCUMENTS

| | | | | |
|---|---|---|---|---|
| 7,865,293 | B2 * | 1/2011 | Ishizuka et al. | 701/104 |
| 8,061,329 | B2 | 11/2011 | Pursifull et al. | |
| 2010/0096480 | A1 | 4/2010 | Kondo et al. | |
| 2010/0263633 | A1 | 10/2010 | Kondo et al. | |
| 2011/0214643 | A1 * | 9/2011 | Blizard et al. | 123/468 |
| 2012/0325936 | A1 | 12/2012 | Rodriguez-Amaya et al. | |

FOREIGN PATENT DOCUMENTS

| | | |
|---|---|---|
| RU | 2087740 | 8/1997 |
| RU | 2215178 C2 | 10/2003 |
| UA | 3874 | 12/1994 |
| WO | 9835210 | 8/1998 |
| WO | 2007132199 | 11/2007 |
| WO | 2009071472 | 6/2009 |
| WO | 2010127889 | 11/2010 |

OTHER PUBLICATIONS

PCT International Search Report for Application No. PCT/EP2010/068828 dated Feb. 23, 2011, 2 pages.

United States Patent Office Action for U.S. Appl. No. 13/519,085 dated Jun. 25, 2014 (7 pages).

* cited by examiner

FUEL INJECTOR HAVING PRESSURE SENSOR

BACKGROUND OF THE INVENTION

Pressure sensors in fuel injection systems for measuring the fuel pressure are known in the state of the art. Such known pressure sensors are generally arranged in a central pressure accumulator of the injection system where they are subjected to the high pressure of the fuel in the injection system. In modern common rail systems the fuel pressure may be a few thousand bar. The pressure sensors therefore have to be sealed off from the high pressure of the fuel in the injection system and thus constitute an elaborate and cost-intensive component. Furthermore, finding a suitable location at which to fit the pressure sensor is something of a problem in systems having no central pressure accumulator.

SUMMARY OF THE INVENTION

An object of the present invention is to provide a simple and inexpensive device for measuring the fuel pressure in a fuel injection system.

This object is achieved by a fuel injector as claimed in the independent claim 1. Advantageous developments are set forth in the dependent claims.

A fuel injector according to the invention has a high-pressure area, which in operation for at least some of the time contains fuel under high injection pressure. A fuel injector according to the invention also has a low-pressure area, which in operation contains no fuel and/or is connected to an outlet, so that a high fuel pressure does not build up in the low-pressure area and a lower pressure prevails than in the high-pressure area. A sensor is located in the low-pressure area and a transmission means is arranged so that for at least some of the time it exerts a force, which corresponds to the pressure of the fuel in the high-pressure area, on the sensor.

The invention also encompasses a fuel injection system having a fuel pump, at least one fuel injector according to the invention and a regulating valve. By using a fuel injector according to the invention having an integral pressure sensor, it is possible to dispense with a central pressure accumulator, in which the pressure sensor is fitted. Such an injection system can be designed with few components and is therefore inexpensive.

Since the pressure sensor is located in the fuel injector itself, the pressure can easily be measured, even in systems that do not have a central pressure accumulator. Since the pressure sensor is located in the low-pressure area of the fuel injector, the sensor does not need to have a special high-pressure seal. It is therefore possible to use simple and inexpensive sensors.

In one embodiment the force exerted on the sensor by the transmission means is proportional to the pressure in the high-pressure area. This particularly facilitates evaluation of the values measured by the sensor for determining the fuel pressure prevailing in the system.

In one embodiment the fuel injector comprises a control valve and the sensor is arranged in the low-pressure area of the control valve. Fitting the sensor in the low-pressure area of such a control valve is particularly advantageous.

In one embodiment the fuel injector comprises a pressure-balanced control valve. A fuel injector having a pressure-balanced control valve can be opened and closed by small forces and thus allows particularly short operating times. Such a control valve can be actuated by a small and inexpensive actuator.

In one embodiment the control valve comprises a sleeve-shaped valve needle and the transmission means is embodied as a moveable pressure pin inside the valve needle. Such a valve having a pressure pin arranged inside a sleeve-shaped valve needle allows an especially easy transmission of the pressure from the high-pressure area to a sensor located in the low-pressure area and is easy and inexpensive to produce.

In one embodiment the control valve can be actuated by a solenoid actuator. Solenoid actuators have proven successful when used in fuel injectors and are inexpensive to produce.

In one embodiment the control valve can be actuated by a piezoelectric actuator. Piezoelectric actuators allow particularly short operating times.

In one embodiment a compensating element is arranged between the pressure pin and the sensor. Such a compensating element makes it possible to compensate for angular tolerances between the sensor and the pressure pin and thereby to improve the accuracy of the measurement.

In one embodiment the fuel injection system comprises at least two fuel injectors, the fuel pump, the fuel injectors and the regulating valve being connected in series in such a way that in each case the outlet of one fuel injector is connected to the inlet of a succeeding fuel injector. Such a series arrangement makes it possible to minimize the overall length of the pressure lines of the fuel injection system. Such an injection system is therefore particularly inexpensive to produce.

BRIEF DESCRIPTION OF THE DRAWINGS

The invention will be explained in more detail below with reference to the figures attached, of which.

DETAILED DESCRIPTION

Figure 1:
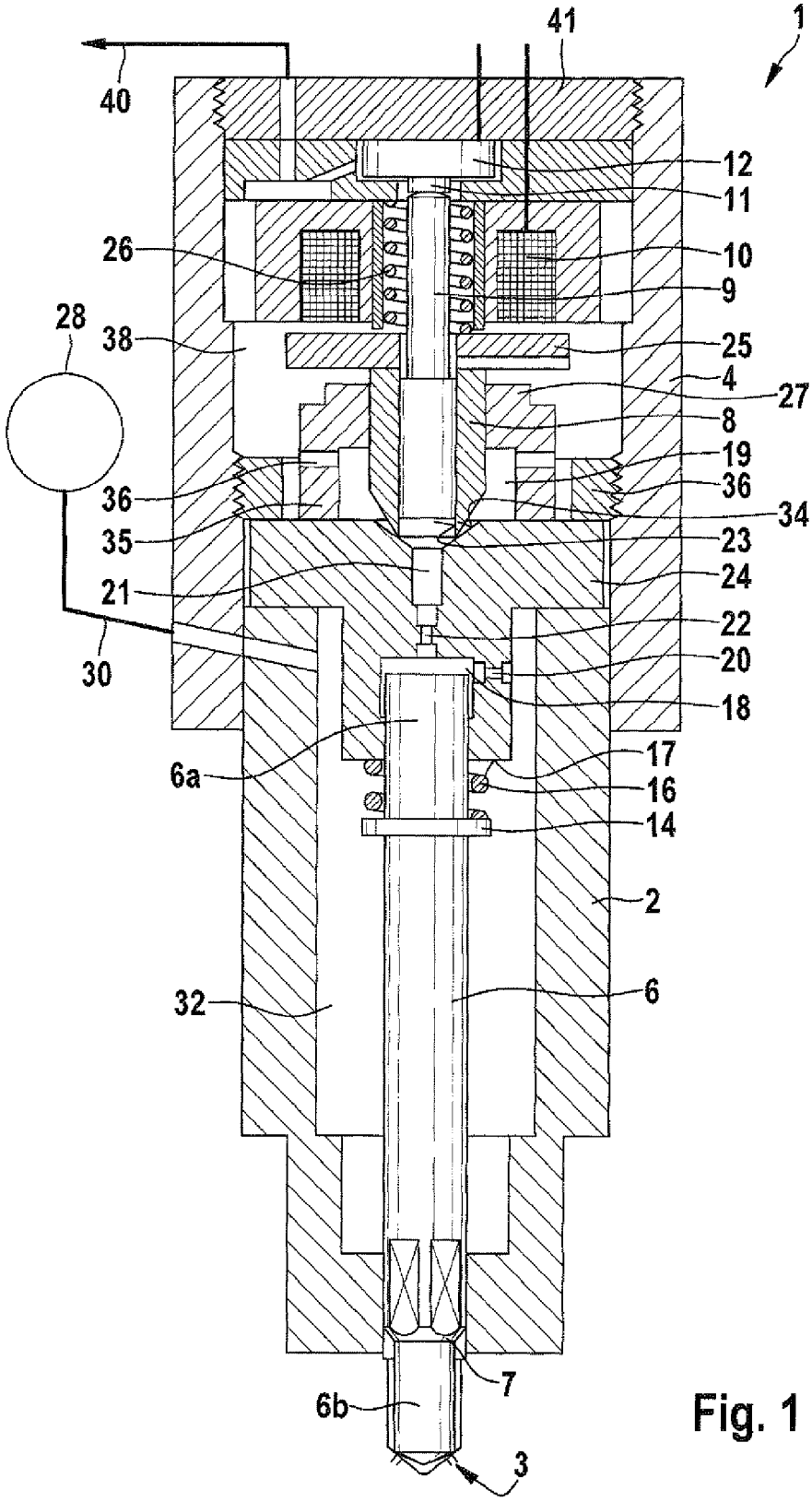
FIG. 1 shows a sectional representation of a fuel injector according to the invention.

FIG. 1 shows a sectional representation of a fuel injector 1 according to the invention. The fuel injector 1 comprises a cylindrical nozzle body 2 shown in the lower area of FIG. 1, and a cylindrical union nut 4, which is arranged above the nozzle body 2 and is tightly screwed to the nozzle body 2. At its end shown at the top in FIG. 1, the injector 1 is closed by a closure plate 41, which is screwed hydraulically tight to the union nut 4.

A high-pressure chamber 32, which by way of a fuel inlet 30 can be filled by an external fuel pump 28 with fuel under high pressure, is formed inside the nozzle body 2.

Injection ports 3, through which fuel can flow from the high-pressure chamber 32 into a combustion chamber (not shown), which encloses the lower end of the nozzle body 2, are formed at the end of the nozzle body 2 shown at the bottom of FIG. 1.

The upper end of the high-pressure chamber 32 situated opposite the injection ports 3 is defined by a valve plate 24, which is tightly clamped to the nozzle body 2 by the union nut 4 and hydraulically seals the high-pressure chamber 32 tight.

A cylindrical projection, which encloses a control chamber 18, is formed on the side of the valve plate 24 facing the high-pressure chamber 32. A nozzle needle orifice is formed on the side 17 of the projection remote from the valve plate 24.

A nozzle needle 6 having an upper end **6*a* facing the valve plate 24 and a lower end 6*b* facing the injection ports 3 is arranged along the longitudinal axis of the high-pressure chamber 32. The nozzle needle 6** may be composed of one piece or it may be built up from multiple parts which are operatively connected together.

The upper end 6*a* of the nozzle needle 6 is introduced through the nozzle needle orifice, which is formed in the side 17 of the control chamber 18 remote from the valve plate 24, into the control chamber 18, in such a way that the volume of the control chamber 18 can be varied by movement of the nozzle needle 6 parallel to the longitudinal axis.

Below the control chamber 18 a step 14 is formed on the circumference of the nozzle needle 6. A nozzle needle spring 16 is arranged between the step 14 and the side 17 of the control chamber 18 remote from the valve plate 24, so that it elastically braces the nozzle needle 6 against the projection of the valve plate 24. In so doing, the nozzle needle spring 16 presses the lower end 6*b* of the nozzle needle 6 against the injection ports 3 in the lower area of the nozzle body 2, in such a way that the lower end 6*b* of the nozzle needle 6 closes the injection ports 3 and no fuel flows out of the high-pressure chamber 32 through the injection ports 3 into the combustion chamber.

A pressure shoulder 7 is formed above the lower area 6*b* of the nozzle needle 6. In operation the high-pressure chamber 32 is filled with fuel under high pressure and the fuel exerts an upwardly directed force on the nozzle needle 6 by way of the pressure shoulder 7.

An inlet restriction 20 formed in a side wall of the control chamber 18 connects the control chamber 18 hydraulically to the high-pressure chamber 32, so that in hydraulic equilibrium the same pressure prevails in the control chamber 18 as in the high-pressure chamber 32.

The side of the control chamber 18 remote from the nozzle needle 6 is defined by the valve plate 24. An outlet bore 21, which hydraulically connects the control chamber 18 to a cylindrically formed valve chamber 19, which is formed above the side of the valve plate 24 remote from the control chamber 18 and the high-pressure chamber 32, is formed in the valve plate 24 in the area of the control chamber 18.

An outlet restriction 22 is formed in the outlet bore 21. The dimensioning of the outlet restriction 22 allows the flow through the outlet bore to be regulated.

Two outlet bores 36, which hydraulically connect the valve chamber 19 to a low-pressure chamber 36 formed above the control plate 24 in the union nut 4, are formed in a wall 35, which encloses the valve chamber 19. The low-pressure chamber 36 is hydraulically connected to a fuel outlet 40, through which fuel runs out of the injector 1, so that a high fuel pressure does not build up in the low-pressure chamber 36.

A seal seat 34 is formed on the control plate 24, at the end of the outlet bore 21 which faces the valve chamber 19. A valve needle 8, which is moveable in the longitudinal direction of the injector 1 between a lower, closed position and an upper, opened position, is located in the valve chamber 19. Here, when it is in the lower, closed position, the valve needle 8 rests on the valve plate 24 and closes the seal seat 34. When it is situated in an upper, opened position, the valve needle 8 is lifted off from the valve plate 24 and exposes the seal seat 34.

When the valve needle 8 is in an upper, opened position, and exposes the seal seat 34, the control chamber 18 is hydraulically connected to the valve chamber 19 via the outlet bore 21 and the outlet restriction 22. When the valve needle 8 is in the lower, closed position and closes the seal seat 34, the connection between the control chamber 18 and the valve chamber 19 is interrupted.

The valve needle 6 extends through an aperture formed in an upper boundary 27 of the valve chamber 19 remote from the valve plate 24 into the low-pressure chamber 38 and at its upper end in the low-pressure chamber 38 remote from the valve plate 24 comprises an armature plate 25, which extends at right-angles to the longitudinal direction of the injector 1 in the low-pressure chamber 38.

An armature spring 36 is arranged between the armature plate 25 and the closure plate 41, which closes the injector 1 at its upper end. The armature spring 36 braces the armature plate 25 elastically against the closure plate 41, so that the valve needle 8 is pressed by the force of the armature spring 26 into the lower, closed position against the seal seat 34 formed on the valve plate 24 and hydraulically seals the seal seat 34 tight.

Between the armature plate 25 and the closure plate 41, inside the union nut 4, is a solenoid 10, which is designed in such a way that the armature plate 25, through activation of the solenoid 10, is moved against the force of the armature spring 26 upwards towards the closure plate 24 into an upper, opened position, and in so doing lifts the valve needle 8 out of the seal seat 34. The seal seat 34 is therefore opened by activation of the solenoid 10. Fuel flows out of the control chamber 18 through the outlet bore 21 and the outlet restriction 22 into the valve chamber 19 and out of the valve chamber 19 through the outlet ports 36 on into the low-pressure chamber 38 and into the fuel outlet 40.

Due to the discharge of fuel from the control chamber 18 as described, the fuel pressure in the control chamber 18 is reduced and is no longer sufficient to hold the nozzle needle 6 in the lower, closed position against the force which the fuel under high pressure in the high-pressure chamber 32 exerts on the pressure shoulder 7 formed at the lower end 6*b* of the nozzle needle 6. The nozzle needle 6 moves upwards towards the valve plate 24 and exposes the injection ports 3. Fuel flows out of the high-pressure chamber 32 through the injection ports 3 into the combustion chamber (not shown), which encloses the lower end of the nozzle body 2.

To terminate the injection sequence, the solenoid 10 is deactivated. The armature spring 26 presses the armature 2 into the lower, closed position, in which the valve needle 8 closes the seal seat 34. With the seal seat 34 closed, fuel, which flows out of the high-pressure chamber 32 through the inlet restriction 20 into the control chamber 18, cannot run out of the control chamber 18 into the valve chamber 19 and the pressure in the control chamber 18 increases. The increased pressure in the control chamber 18 exerts a downwardly directed force on the nozzle needle 6, which together with the force of the nozzle needle spring 16 presses the nozzle needle 6 into the lower, closed position. The lower end 6*b* of the nozzle needle 6 closes the injection ports 3 and no further fuel flows out of the high-pressure chamber into the combustion chamber through the injection ports 3.

A central valve needle bore 23 is formed in the valve needle 8 along the longitudinal axis of the injector 1. A pressure pin 9, which is moveable along the longitudinal axis of the injector 1, parallel to the direction of movement of the nozzle needle 6 and the valve needle 8 inside the valve needle bore 23, is fitted into the valve needle bore 23 so that it is high-pressure tight. The pressure pin 9 extends above the valve needle 8 centrally through a bore formed in the armature plate 25, the armature spring 26 and the solenoid 10, and above the solenoid 10 is operatively connected to a sensor 12 arranged on the closure plate, in such a way that a force acting on the lower end face of the pressure pin 9 facing the outlet bore 32 in the valve plate 24 is transmitted to the sensor 12.

In the exemplary embodiment shown in FIG. 1 a compensating element 11 is provided between the upper end face of the pressure pin 9 facing the sensor 12 and the face of the sensor 12 facing the pressure pin 9. The compensating element 11 makes it possible to compensate for angular tolerances between the sensor 12 and the pressure pin 9 and to increase the accuracy of the measurements made by the sensor 12.

In the lower, closed position of the valve needle 8, that is to say when the valve needle 8 is resting on the seal seat 34 formed on the valve plate 24 and closes the connection between the control chamber 18 and the valve chamber 19, the high fuel pressure prevailing in the control chamber 19 acts through the outlet bore 21 on the end face of the pressure pin 9 facing the outlet bore 21. The pressure pin 9 transmits a force, which is proportional to the fuel pressure in the control chamber 18, to the sensor 12.

Since the control chamber 18 is hydraulically connected via the inlet restriction 20 to the high-pressure chamber 32, in hydraulic equilibrium the fuel pressure in the control chamber 18 is equal to the fuel pressure in the high-pressure chamber 32. The force exerted on the sensor 12 by the pressure pin 9 is therefore proportional to the fuel pressure in the high-pressure chamber 32. The fuel pressure in the high-pressure chamber 32 can easily be determined from the value measured by the sensor 12.

Since the sensor 12 is located in the low-pressure area of the injector 1, it is not necessary for the sensor 12 to be embodied as a high pressure-resistant sensor. Instead a sensor 12 of simple construction that is inexpensive to produce may be used.

During the injection sequence, that is to say when the valve needle 8 has been moved into an upper, opened position by activation of the solenoid 10, so that the seal seat 34 is opened, the outlet bore 21 is hydraulically connected to the low-pressure chamber 38 via the valve chamber 19 and the ports 36. In this state there is no high pressure bearing on the lower end face of the pressure pin 9, so that in this state the high pressure of the fuel system cannot be measured by the sensor 12. The period in which the seal seat 34 is closed between the injection sequences, and the lower end face of the pressure pin 9 is exposed to the high fuel pressure of the system, is sufficient to undertake a reliable pressure measurement.

Figure 2:
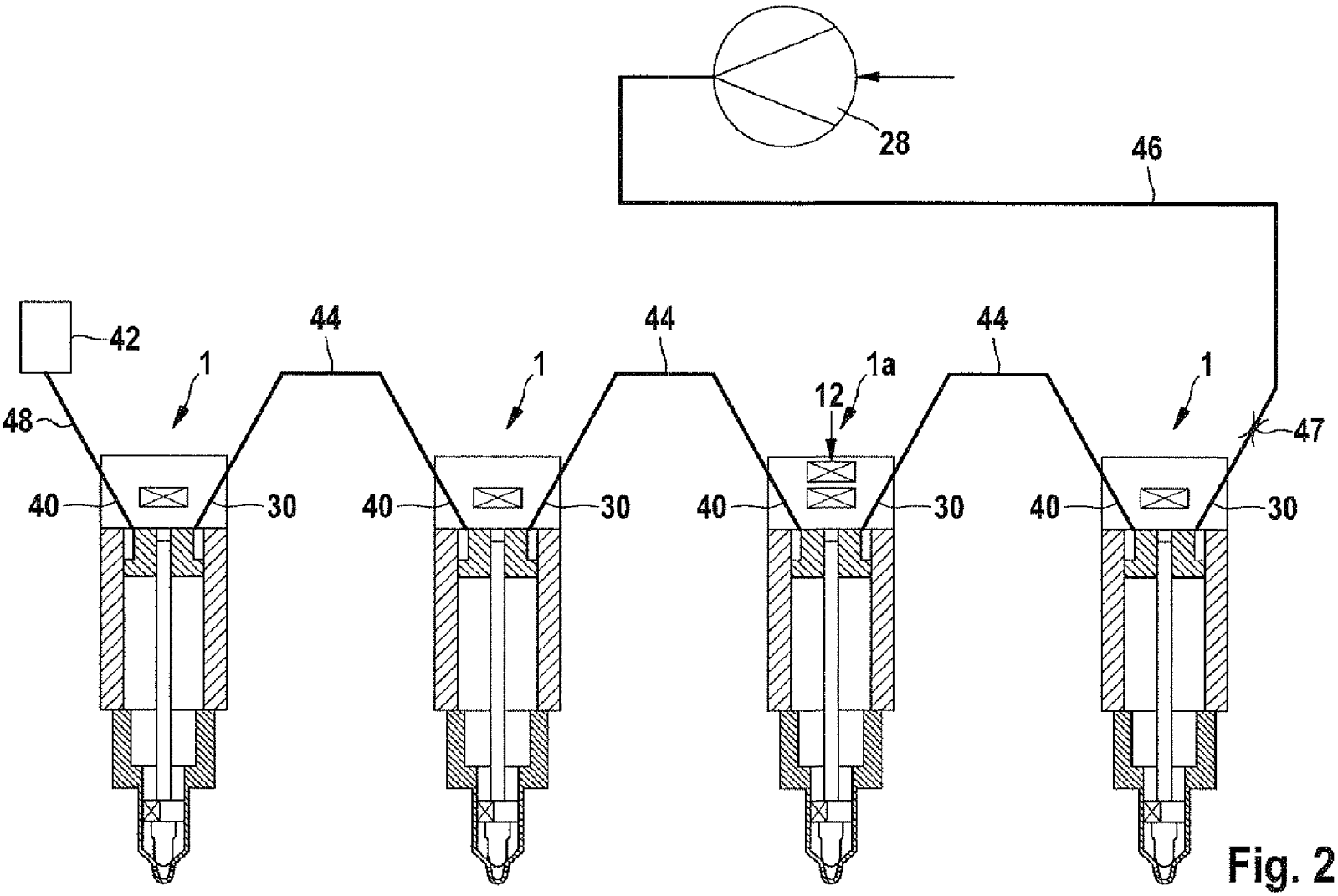
FIG. 2 shows a schematic representation of a fuel injection system having at least one fuel injector according to the invention.

FIG. 2 shows a fuel injection system having four fuel injectors 1, 1*a*, a fuel pump 28 and a pressure regulating valve 42.

The outlet of the fuel pump 28 is connected to the inlet 30 of a first injector 1 via a fuel inlet line 46 and an inlet restriction 47. The fuel outlet 40 of the first injector 1 is connected to the inlet 30 of a second injector 1 via a connecting line 44. The fuel outlet of the second injector 1*a* is connected to the fuel inlet of a third injector 1 via a further connecting line 44. The fuel outlet 40 of the third injector 1 is connected to the fuel inlet 30 of a fourth injector 1 via a third connecting line 44. The fuel outlet 40 of the fourth injector 1 is connected to a pressure regulating valve 42 via an outlet line 38. The second fuel injector 1*a* is embodied as a fuel injector according to the invention having a pressure sensor 12 incorporated into the low-pressure area.

The fuel injection system shown in FIG. 2 does not have a central pressure accumulator. Nevertheless, the fuel pressure in the fuel injection system can be reliably measured, since at least one of the fuel injectors 1 is embodied as a fuel injector 1*a* according to the invention having an integral pressure sensor 12. One or more of the fuel injectors 1 may be embodied, as required, as a fuel injector 1*a* according to the invention having a pressure sensor 12 or as conventional fuel injectors 1 having no pressure sensor 12. The pressure regulating valve 42 serves for adjusting the fuel pressure in the system. Since the fuel injectors 1, la are connected to one another in series, a single pressure regulating valve 42 is sufficient to regulate the fuel pressure in the injection system. This eliminates the need both for a central pressure accumulator and for additional connecting lines. Such a fuel system is easy and inexpensive to produce.

What is claimed is:

1. A fuel injector (1) comprising a high-pressure area (32), which in operation contains fuel under high pressure, a low-pressure area (38), which in operation contains fuel under low pressure, a sensor (12) located in the low-pressure area (38), a transmission member (9), which is arranged to exert a force on the sensor (12) corresponding to the pressure of the fuel in the high-pressure area (32), and a control valve, wherein the sensor (12) is arranged in a low-pressure area (38) of the control valve, wherein the control valve is pressure-balanced, and wherein the control valve includes a valve needle (8) and the transmission member (9) includes a pressure pin (9) arranged inside the valve needle (8).

2. The fuel injector (1) as claimed in claim 1, wherein the force exerted on the sensor (12) by the transmission member (9) is proportional to the pressure of the fuel in the high-pressure area (32).

3. The fuel injector (1) as claimed in claim 1, wherein the control valve is actuated by a solenoid actuator (10).

4. The fuel injector (1) as claimed in claim 1, wherein the control valve is actuated by a piezoelectric actuator.

5. The fuel injector (1) as claimed in claim 1, wherein a compensating element (11) is arranged between the pressure pin (9) and the sensor (12).

6. A fuel injection system comprising a fuel pump (28), a regulating valve (42), and at least one fuel injector (1), the fuel injector including a high-pressure area (32), which in operation contains fuel under high pressure, a low-pressure area (38), which in operation contains fuel under low pressure, a sensor (12) located in the low-pressure area (38), a transmission member (9), which is arranged to exert a force on the sensor (12) corresponding to the pressure of the fuel in the high-pressure area (32), and a control valve, wherein the sensor (12) is arranged in a low-pressure area (38) of the control valve, wherein the control valve is pressure-balanced, and wherein the control valve includes a valve needle (8) and the transmission member (9) includes a pressure pin (9) arranged inside the valve needle (8).

7. The fuel injection system as claimed in claim 6, having at least two fuel injectors (1), wherein an inlet (30) of a first fuel injector (1) is connected to the fuel pump (28), an outlet (40) of the first fuel injector (1) is connected to an inlet (30) of a succeeding fuel injector (1), and an outlet (40) of a last fuel injector (1) is connected to the regulating valve (42).

8. A fuel injector (1) comprising a high-pressure area (32), which in operation contains fuel under high pressure, a low-pressure area (38), which in operation contains fuel under low pressure, a sensor (12) located in the low-pressure area (38), a transmission means (9), which is arranged to exert a force on the sensor (12) corresponding to the pressure of the fuel in the high-pressure area (32), and a control valve, wherein the sensor (12) is arranged in a low-pressure area (38) of the control valve, wherein the control valve is pressure-balanced, and wherein the control valve includes a valve needle (8) and the transmission means (9) includes a pressure pin (9) arranged inside the valve needle (8).

9. The fuel injector (1) as claimed in claim 8, further comprising a compensating element (11) between the pin (9) and the sensor (12).

10. The fuel injector (1) as claimed in claim 1, wherein the transmission member (9) exerts a force on the sensor intermittently.

11. The fuel injector (1) as claimed in claim 8, wherein the transmission means (9) exerts a force on the sensor intermittently.

12. The fuel injector (1) as claimed in claim 8, wherein the force exerted on the sensor (12) by the transmission means (9) is proportional to the pressure of the fuel in the high-pressure area (32).

13. The fuel injection system (1) as claimed in claim 6, further comprising a compensating element (11) between the pin (9) and the sensor (12).

14. The fuel injection system (1) as claimed in claim 6, wherein the transmission member (9) exerts a force on the sensor intermittently.

15. The fuel injection system (1) as claimed in claim 6, wherein the force exerted on the sensor (12) by the transmission member (9) is proportional to the pressure of the fuel in the high-pressure area (32).

* * * * *